US007353652B2

(12) United States Patent
Osburn

(10) Patent No.: US 7,353,652 B2
(45) Date of Patent: Apr. 8, 2008

(54) HYDRAULICALLY OPERATED LOADING APPARATUS WITH DUAL THREE-FUNCTION JOYSTICK CONTROLS

(75) Inventor: David H. Osburn, Frostproof, FL (US)

(73) Assignee: Petersen Industries, Inc., Lakes Wales, FL (US)

( * ) Notice: Subject to any disclaimer, the term of this patent is extended or adjusted under 35 U.S.C. 154(b) by 36 days.

(21) Appl. No.: 11/301,778

(22) Filed: Dec. 13, 2005

(65) Prior Publication Data

US 2007/0131292 A1 Jun. 14, 2007

(51) Int. Cl.
*B66C 3/16* (2006.01)
*E02F 3/85* (2006.01)

(52) U.S. Cl. ..... 60/484; 74/471 XY; 74/471 R; 74/480 R; 180/321; 251/289

(58) Field of Classification Search ..... 37/466; 74/480 R, 471 R, 473.33, 471 XY, 490.15; 137/636.3; 172/432; 180/321; 60/484; 251/289, 293, 290, 235
See application file for complete search history.

(56) References Cited

U.S. PATENT DOCUMENTS 4,012,069 A * 3/1977 Carson ..... 294/68.23
5,232,057 A * 8/1993 Renard ..... 74/471 XY
5,480,276 A * 1/1996 Mozingo ..... 74/471 XY
6,019,133 A * 2/2000 Riedel et al. ..... 137/636
6,971,194 B2 * 12/2005 McClelland et al. ..... 180/322

* cited by examiner

*Primary Examiner*—Thomas E. Lazo
(74) *Attorney, Agent, or Firm*—Greer, Burns & Crain, Ltd

(57) ABSTRACT

A control apparatus is provided for operating six hydraulic valves from two different positions. The control apparatus is particularly suitable for operating the hydraulic controls of a six function trash loader. First and second three-function joysticks are mounted at the first position, and third and fourth three-function joysticks are mounted at the second position. A first set of three rotatable rods extends between the first and third joysticks, and a second set of three rotatable rods extends between the second and fourth joysticks. Each joystick includes a handle which is movable along a first axis for rotating a first rod of one of the sets, along a second axis for rotating a second rod of the set, and about a third axis for rotating a third rod of the set. A crank arm on each of the six rods is connected to one of the six hydraulic valves so that rotation of each of the rods operates one of the valves.

5 Claims, 13 Drawing Sheets

HYDRAULICALLY OPERATED LOADING APPARATUS WITH DUAL THREE-FUNCTION JOYSTICK CONTROLS

BACKGROUND

This invention relates to a hydraulically operated loading apparatus, and, more particularly, to a control apparatus for operating the hydraulic functions of a hydraulically operated loading apparatus.

U.S. Pat. No. 4,012,069 describes a hydraulically operated loading apparatus for loading trash which is mounted on a vehicle and which loads trash into a container which is carried by the vehicle. The loading apparatus includes a main boom which is mounted on a rotating head, allowing vertical rotation. The rotating head, allowing horizontal rotation, is supported by a structural pedestal supported by the vehicle. The tip boom, mounted to the outer end of the main boom and allowing vertical rotation, also includes a telescoping tip extension for extending the length of the tip boom. A grapple or clamshell-type bucket is mounted on the end of the telescoping extension of the tip boom with a rotary swivel allowing continuous grapple.

The apparatus of the type which is described in U.S. Pat. No. 4,012,069 typically includes six hydraulic actuators. One of the actuators slews or rotates the main boom relative to the base. Other actuators raise and lower the main boom and the tip boom. Another actuator extends and retracts the tip boom extension. An actuator rotates the grapple, and a final actuator opens and closes the grapple. Each actuator is a double acting actuator which is controlled by a hydraulic valve which supplies pressurized hydraulic fluid to the actuator.

Each valve can be operated by a separate controller, e.g., a lever or handle for opening and closing the valve. Six valves require six separate controllers, which are difficult to operate by one person.

FIG. 1 illustrates one type of prior art control mechanism for operating hydraulic actuators. A rotating head 10 is mounted on a pedestal 11. An upper set of seven rods 12 and a lower set of four rods 13 are rotatably mounted in vertically extending plates 14 which are attached to the pedestal. Each of the upper rods 12 includes a horizontal center portion 12*a* and a pair of upwardly extending handle portions 12*b*. Each of the lower rods 13 includes a horizontal center portion 13*a* and a pair of rearwardly extending handle portions 13*b*.

A valve bank 15 is mounted on the pedestal and includes a plurality of valve spool assemblies 16 for operating the hydraulic actuators of the device. A crank arm 17 is attached to each of the horizontal portions 12*a* and 13*a* so that movement of one of the handle portions 12*b* and 13*b* operates one of the valve spools. The two sets of handle portions permit the hydraulic actuators to be operated from either side of the pedestal.

FIGS. 2-4 illustrate another prior art control mechanism for operating hydraulic actuators. FIG. 2 illustrates a seat 20 in a rear facing load cab. Right and left three-function joysticks 21 and 22 are mounted on the right and left sides of the seat.

The joystick 22 on the left side of the seat controls three hydraulic valve spools 23-25 (FIG. 3). The three spool hydraulic control valve is mounted beneath the floor of the control cab (indicated in phantom outline in FIG. 3) for reduction in noise and heat. In each case, moving the joystick causes one of three reach rods 26, 27, and 28 extending through the floor to move a hydraulic valve spool that then directs pressurized hydraulic fluid to actuate a hydraulic motor or hydraulic cylinder. Moving the joystick to the left actuates the valve spool that causes the loader to slew to the left; just as moving the joystick to the right causes the loader to slew to the right. Moving the joystick back extends the lift cylinder and raises the main boom. Conversely, moving the joystick forward lowers the main boom. Rotating the joystick counterclockwise to the left extends the tip extension boom. Rotating the joystick to clockwise to the right retracts the tip extension boom.

The joystick 21 on the right side of the seat controls three each hydraulic valve spools of another valve mounted under the floor of the control cab. Moving the joystick to the left closes the grapple. Conversely, moving the joystick to the right opens the grapple. Moving the joystick back extends the tip boom cylinder and raises the tip boom. Moving the joystick forward lowers the tip boom. Rotating the joystick counterclockwise causes the grapple to rotate counterclockwise. Rotating the joystick clockwise causes the grapple to rotate clockwise.

Additionally, there are four levers mounted behind the left joystick that control the outriggers. Two of the levers extend and retract the horizontal movement of the two outriggers. The other two levers extend and retract the vertical movement of the outriggers.

I understand that John Deere Company might be using a three-function mechanical joystick for operating the blade of a bulldozer. However, I am not familiar with the details of either the structure or the operation of the joystick.

SUMMARY OF THE INVENTION

The invention utilizes a first pair of three-function joysticks at a first station and a second pair of three-function joysticks at a second station to operate six hydraulic valves. One joystick at each station operates three of the valves, and the second joystick at each station operates the other three valves. Six rotatable rods extend between the two stations, and each rod is rotatable by one of the joysticks at each station. A crank arm is connected to each rod for operating one of the valves. The six hydraulic valves control main boom rotation, raising and lowering the main boom, raising and lowering the tip boom, tip boom extension, rotation of the grapple, and opening and closing the grapple.

Each mechanical joystick controls three of the loader functions instead of three individual levers. A loader requires constant use of six valves for optimum loader production. Dual joysticks with control of three functions each allows the operator to keep each hand on the same control handle full time. By stepping to either side of the vehicle, the operator has improved visibility around a loader, the loader body, or obstructions.

Dual sets of three-function joysticks operating the same six valve spool assemblies also reduces cost and hydraulic complexity. The valve bank could also be operated by pilot-operated hydraulic controls or electronic joysticks which control solenoid valves, but mechanical joysticks are simple, reliable, less expensive, and less susceptible to damage when used in outside weather environment and when exposed to steam cleaners and pressure washers.

A three-function left joystick allows for simultaneous slewing, vertical main boom motion, and telescopic section control. A three-function right joystick allows simultaneous vertical tip boom motion, bucket or grapple rotation, and bucket or grapple open/close motion. Those functions are difficult, if not impossible, to accomplish with the use of one hand and three separate control handles.

DESCRIPTION OF THE DRAWING

The invention will be explained in conjunction with an illustrative embodiment shown in the accompanying drawing, in which.

DESCRIPTION OF SPECIFIC EMBODIMENT

Figure 5:
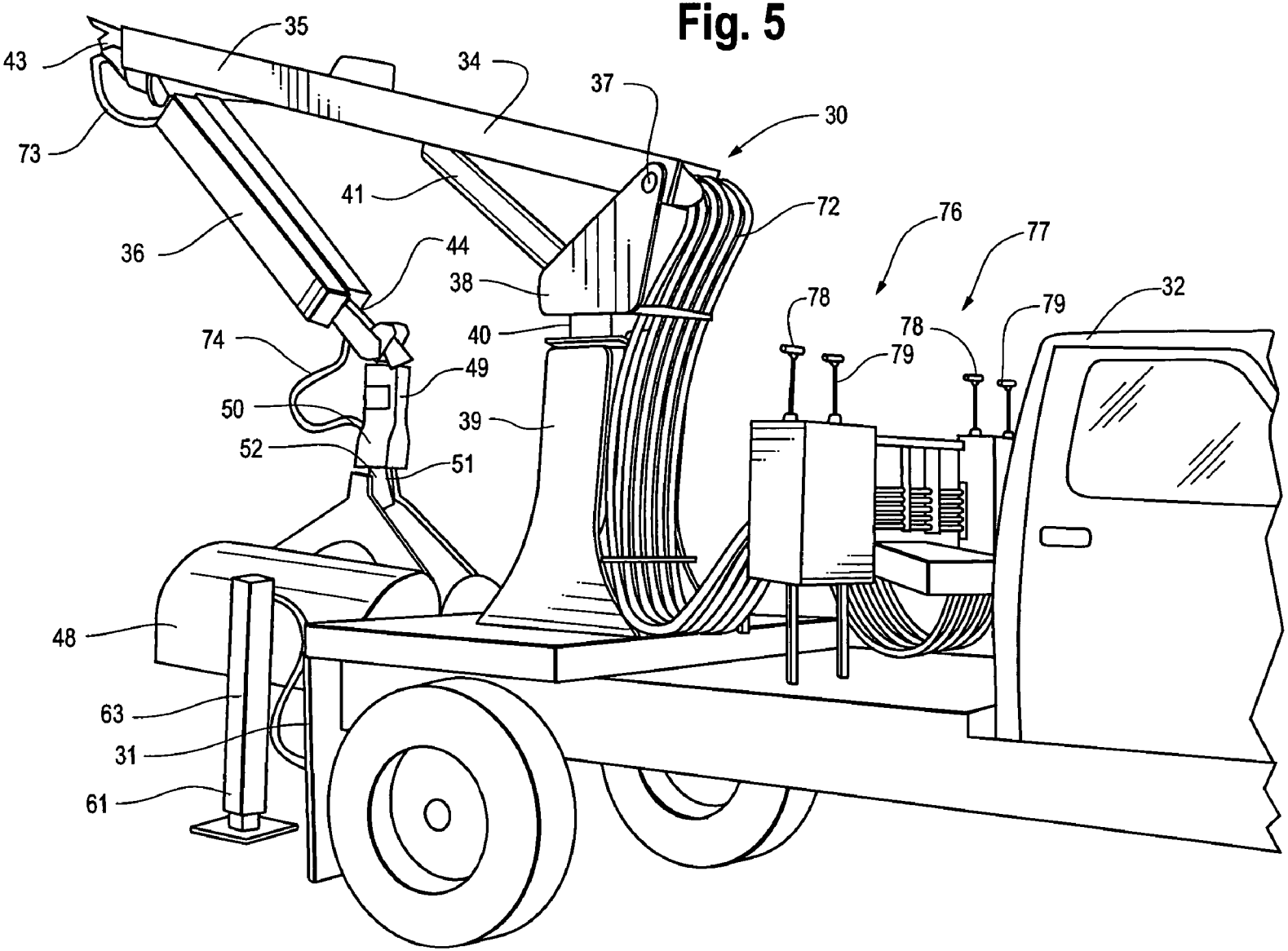
FIG. 5 is a fragmentary perspective view of a loading apparatus which is equipped with a hydraulic control apparatus in accordance with the invention.

Referring to FIG. 5, loading apparatus 30 is supported by a chassis or body 31 of a vehicle 32. The loading apparatus may be generally of the type which is described in U.S. Pat. No. 4,012,069. The vehicle chassis provides a frame for supporting the loading apparatus.

The loading apparatus includes a two-part boom 34 which includes a main boom arm 35 and a tip boom arm 36. The main boom is pivotally connected by pin 37 to a rotating head 38, and the rotating head 38 is rotatably supported by a pedestal 39 which is mounted on the vehicle body. The pedestal 39 encloses a rotary actuator 40 for rotating the rotating head with respect to the pedestal 39. A hydraulic cylinder 41 is pivotally connected to the main boom 35 and to the rotating head 38 for raising and lowering the boom 34.

Figure 6:
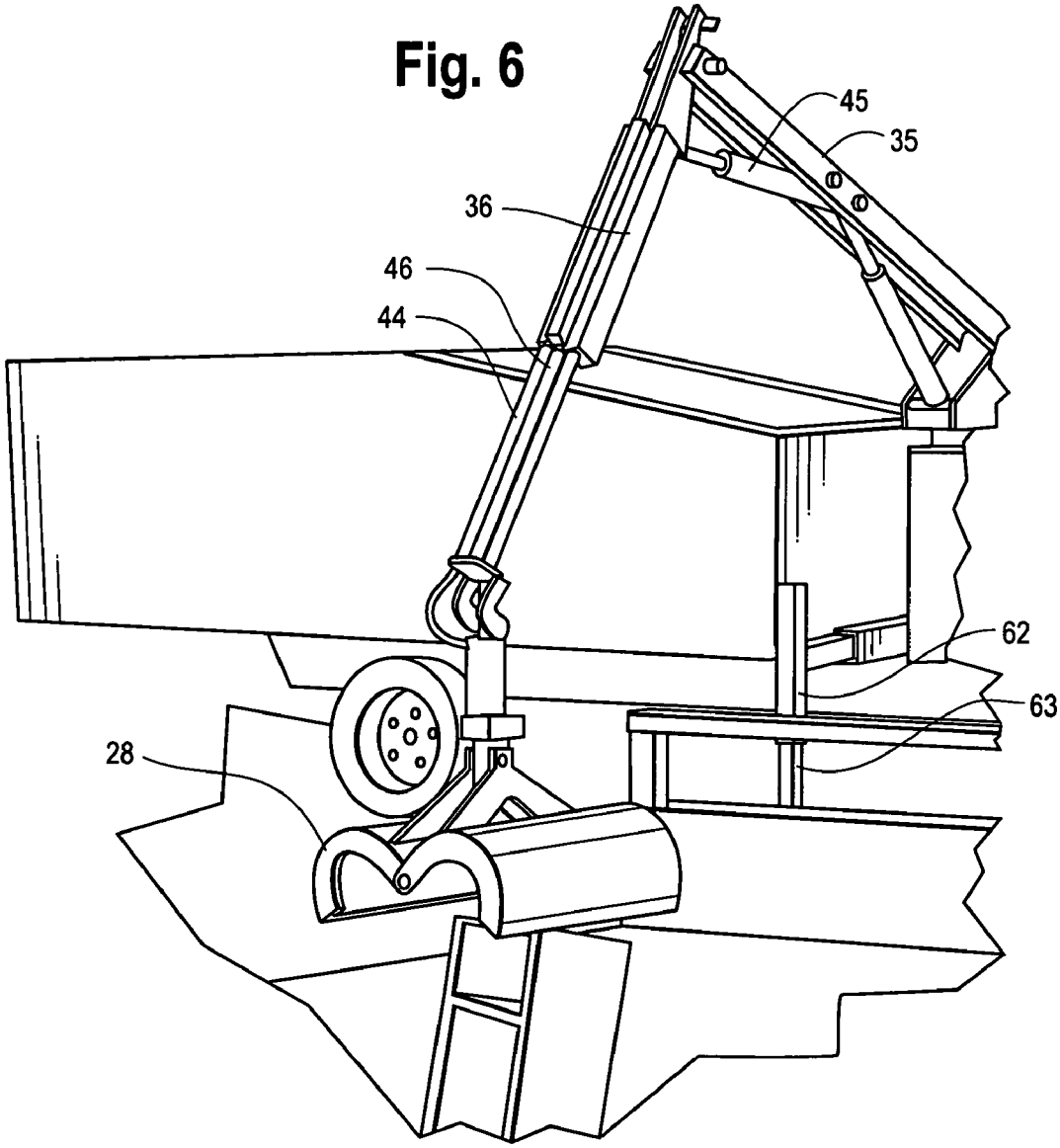
FIG. 6 is a fragmentary perspective view of a loading apparatus in an alternate position.

The tip boom 36 is pivotally connected by a pin 43 to the main boom 35. A tip extension boom 44 is telescopingly received within the tip boom 36. Referring to FIG. 6, a hydraulic cylinder 45 is pivotally connected to the tip boom 36 and to the main boom 35 for raising and lowering the tip boom 36. A hydraulic cylinder 46 is connected to the tip boom 36 and to the tip extension boom 44 for extending and retracting the tip extension boom.

A grapple 48 is pivotally and rotatably connected to the tip extension boom 44. The grapple is pivotally connected to the tip extension boom 44 by a universal joint 49. A hydraulic motor 50 is connected to a rotary swivel 51 and rotatably supports a shaft 52. The particular grapple 48 illustrated in the drawing is a clamshell-type grapple and includes a pair of pivotable jaws 53 and 54 (see also FIGS. 6 and 7) which are pivotally supported by arms 55 and 56 which are carried by the shaft 51. It will be understood the grapple can be replaced with other types of buckets or loaders, and the term "grapple" as used herein is meant to broadly refer to grapples, buckets, loaders, and similar devices.

Figure 7:
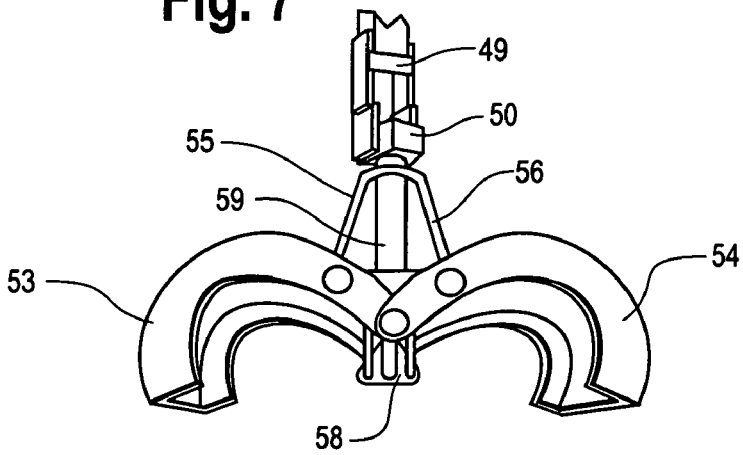
FIG. 7 is an enlarged fragmentary view of the grapple.

The inside ends of the jaws 53 and 54 are pivotally connected to a bar 58 (FIG. 7). Hydraulic cylinder 59 is mounted on the shaft 52 and is connected to the bar 58 for lower and raising the bar 58 and thereby opening and closing the jaws.

A pair of conventional outriggers 61 are mounted on the sides of the vehicle for stabilizing the loading apparatus during use. Each outrigger includes a horizontally telescoping arm 62 (FIG. 6) and a vertical telescoping arm 63. Hydraulic cylinders are positioned within the horizontal and vertical arms for extending and retracting the arms.

The hydraulic actuators 40, 41, 45, 46, 50, and 59 are double acting actuators so that they can move the members which they control in two directions. Each hydraulic actuator is supplied with pressurized hydraulic fluid by a pair of hydraulic hoses.

Figure 8:
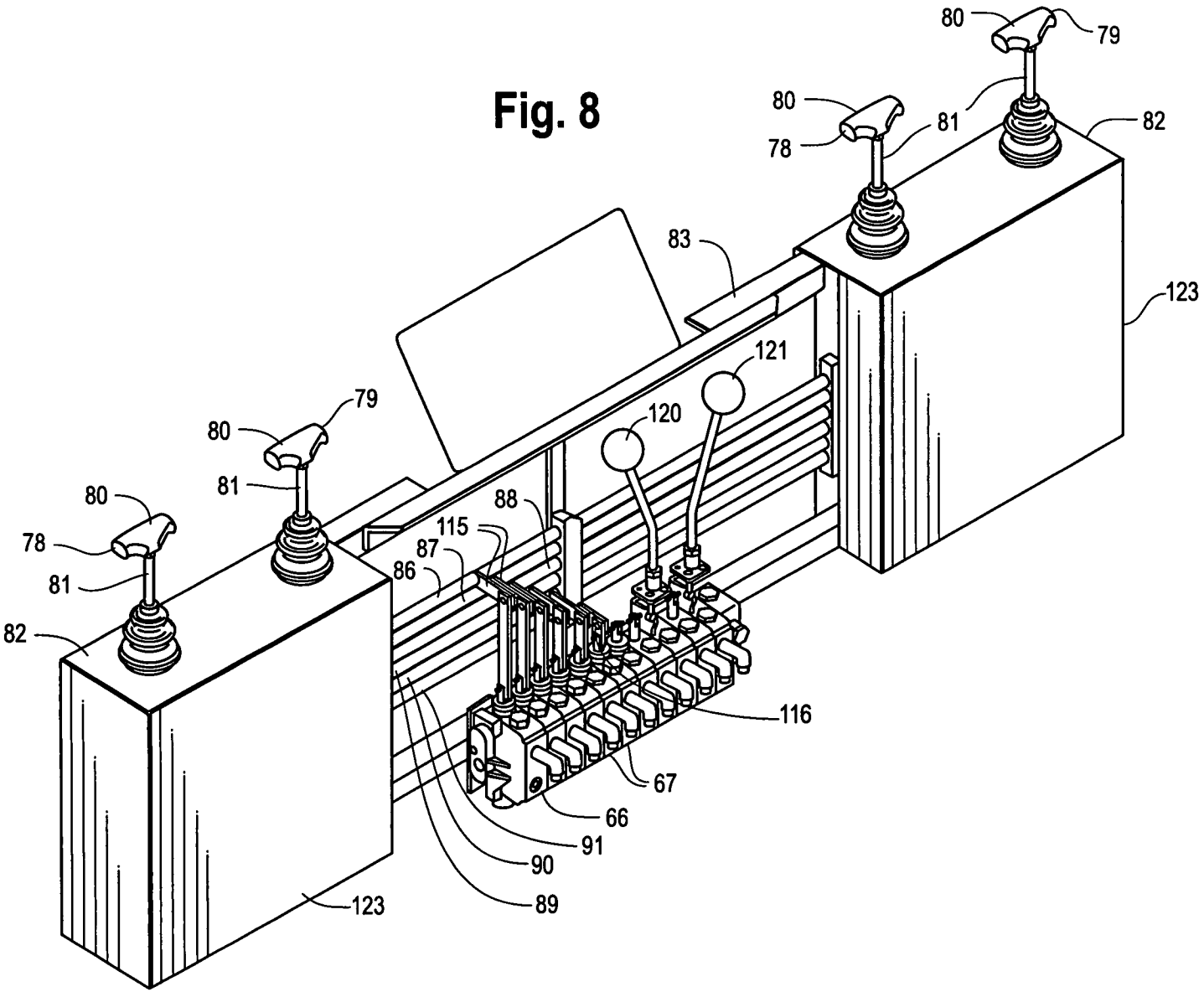
FIG. 8 is a perspective view of the hydraulic control apparatus of the invention.
Figure 9:
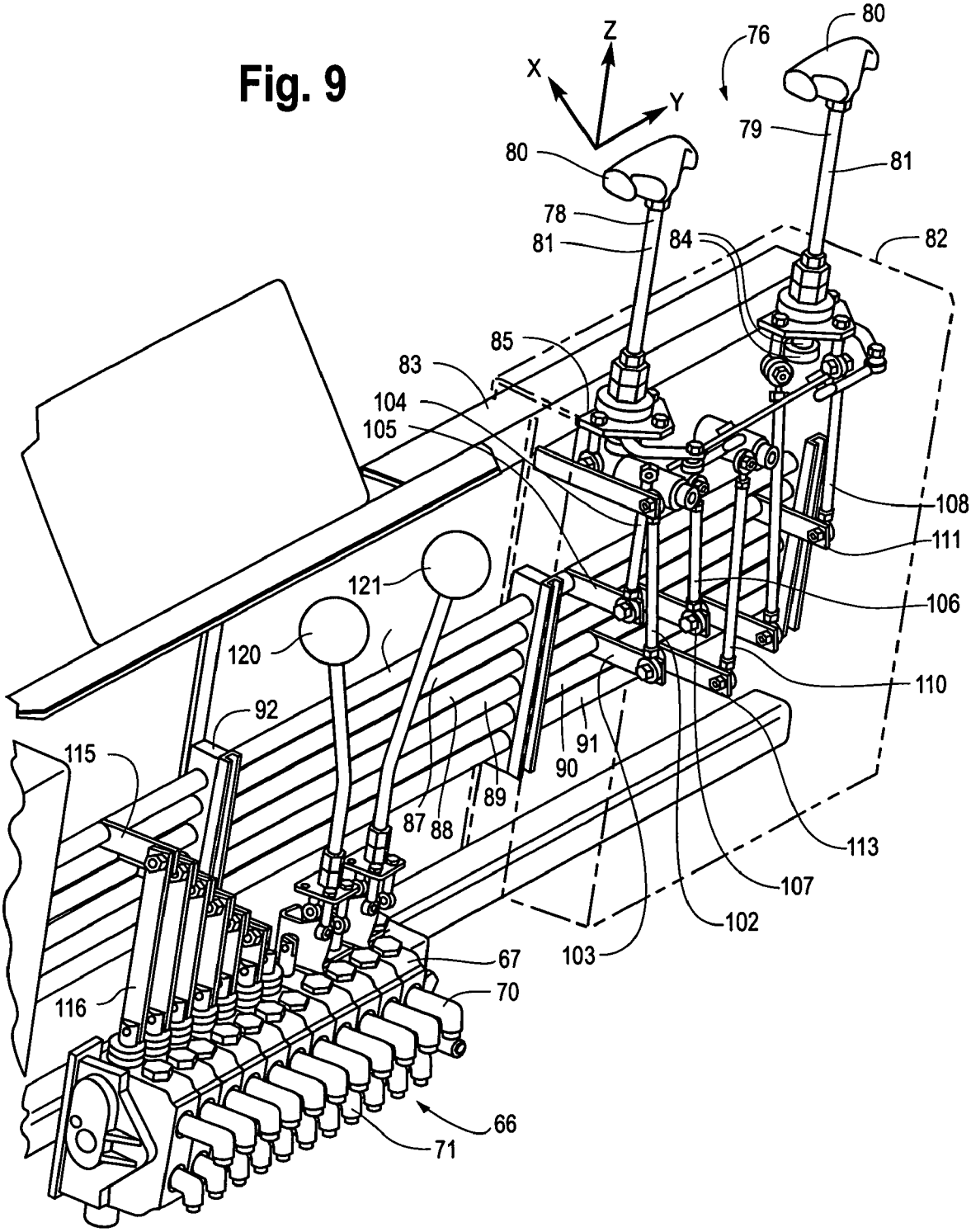
FIG. 9 is an enlarged fragmentary view of the hydraulic control apparatus of FIG. 8 with the cover removed.

Referring to FIGS. 8 and 9, a valve bank 66 is mounted on the loader pedestal 39. The particular valve bank illustrated includes eleven valve spool assemblies 67 and is manufactured by Parker Hannifin Corporation, Hydraulic Valve Division, Elyria, Ohio.

Figure 10C:
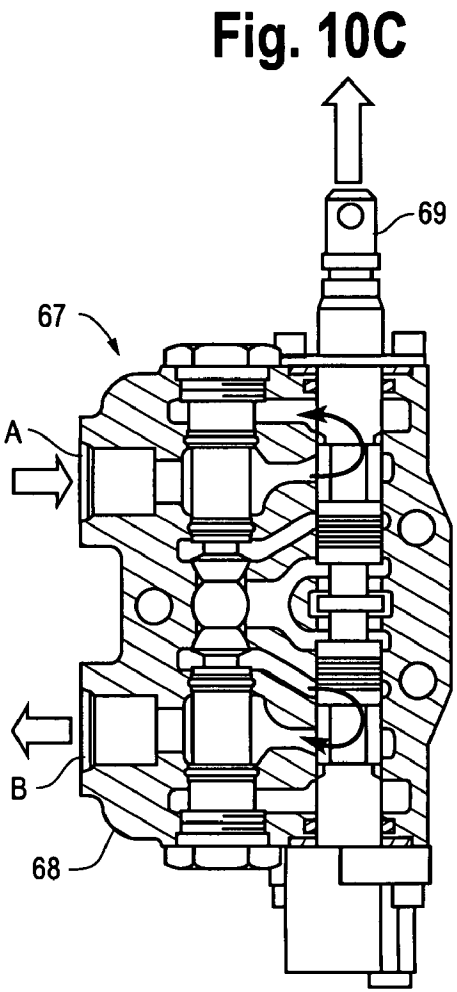
FIGS. 10A through 10C are sectional views of one of the valve spool assemblies.
Figure 10B:
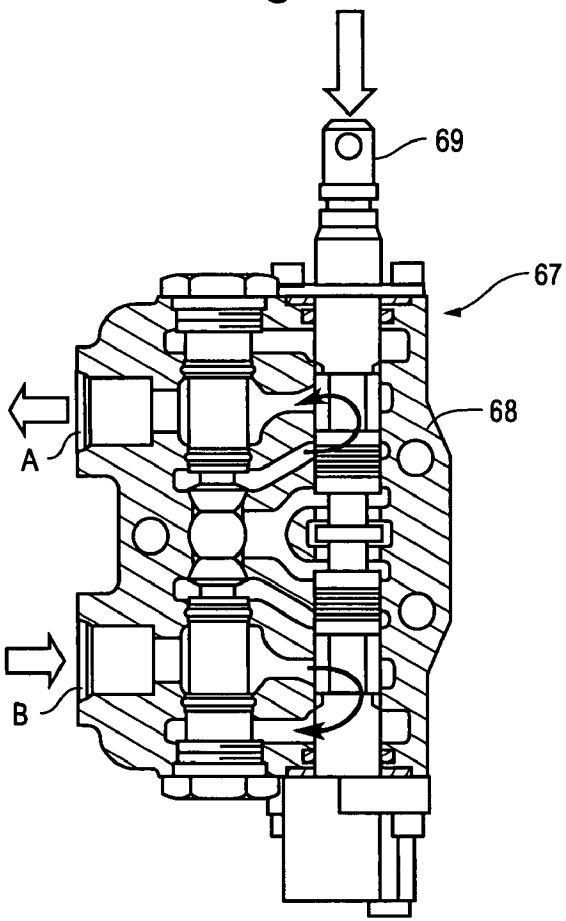
Figure 10A:
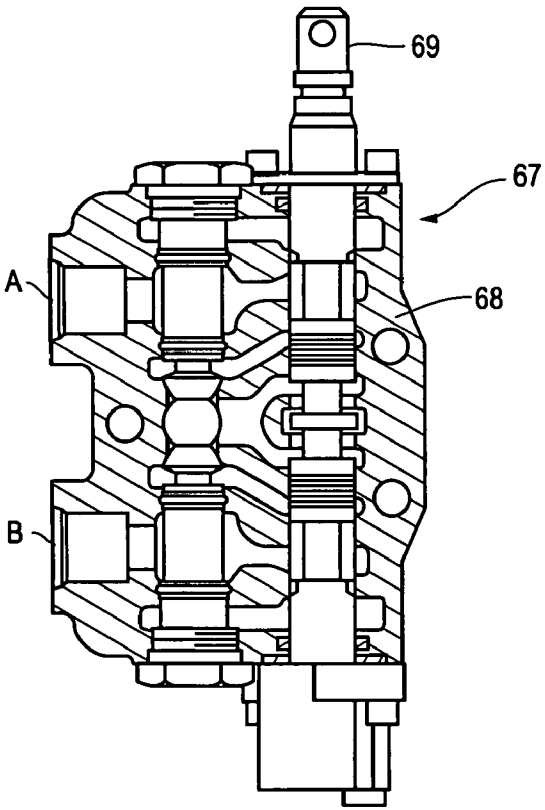

Referring to FIGS. 10A through 10C, each valve spool assembly 67 includes a housing 68 and a conventional double-acting hydraulic valve spool 69 for directing pressurized hydraulic fluid from a hydraulic pump on the vehicle to one of two outlet ports A and B. FIG. 10A illustrates the valve spool in the neutral position. Both ports A and B are closed. FIG. 10B illustrates the flow of hydraulic fluid if the valve spool were moved downwardly to position A. Pressurized hydraulic fluid flows outwardly through port A and hydraulic fluid returns to the tank through port B. FIG. 10C illustrates the flow of hydraulic fluid if the valve spool were moved upwardly to position B. Pressurized hydraulic fluid flows out of port B and port A is connected to the tank.

Referring to FIG. 9, hose fittings 70 and 71 are connected to the ports A and B. Hydraulic hoses are connected to the fittings.

The first six valve spool assemblies 67 on the left side of the valve bank 66 operate the six hydraulic actuators 40, 41, 45, 46, 50, and 59. A pair of hydraulic hoses extends from each valve spool assembly to each one of the actuators. Some of the hoses are illustrated in FIG. 5 at 72, 73, and 74.

As shown in FIG. 8, all six of the valve spool assemblies 67 can be operated at two separate operating stations which are generally designated 76 and 77 in FIG. 5. Each operating station includes a pair of three-function joysticks 78 and 79. Each joystick includes a handle 80 which is mounted on the end of a vertical shaft 81. Each pair of joysticks is mounted in a housing 82 which is mounted on a frame 83.

Referring to FIGS. 9 and 11-13, the lower end of each shaft 81 is mounted on a ball and socket joint 84. The socket 84*a* (FIG. 13) of the ball and socket joint 84 is attached to the frame 83 by a rod 84*b*. A lever plate 85 is attached to the shaft 81. The shaft 81 is movable along an x axis or push-pull axis which extends fore-and-aft of the vehicle, along a y axis or left-right axis which extends laterally across the vehicle, and about a vertical rotary z axis or twisting axis.

Movement of the shaft along each axis rotates one of six horizontal rods 86-91 which are rotatably mounted on the frame 83. The rods advantageously are about one-half inch in diameter and are mounted for rotation in Nylatron bearings 92 on the frame.

Figure 1:
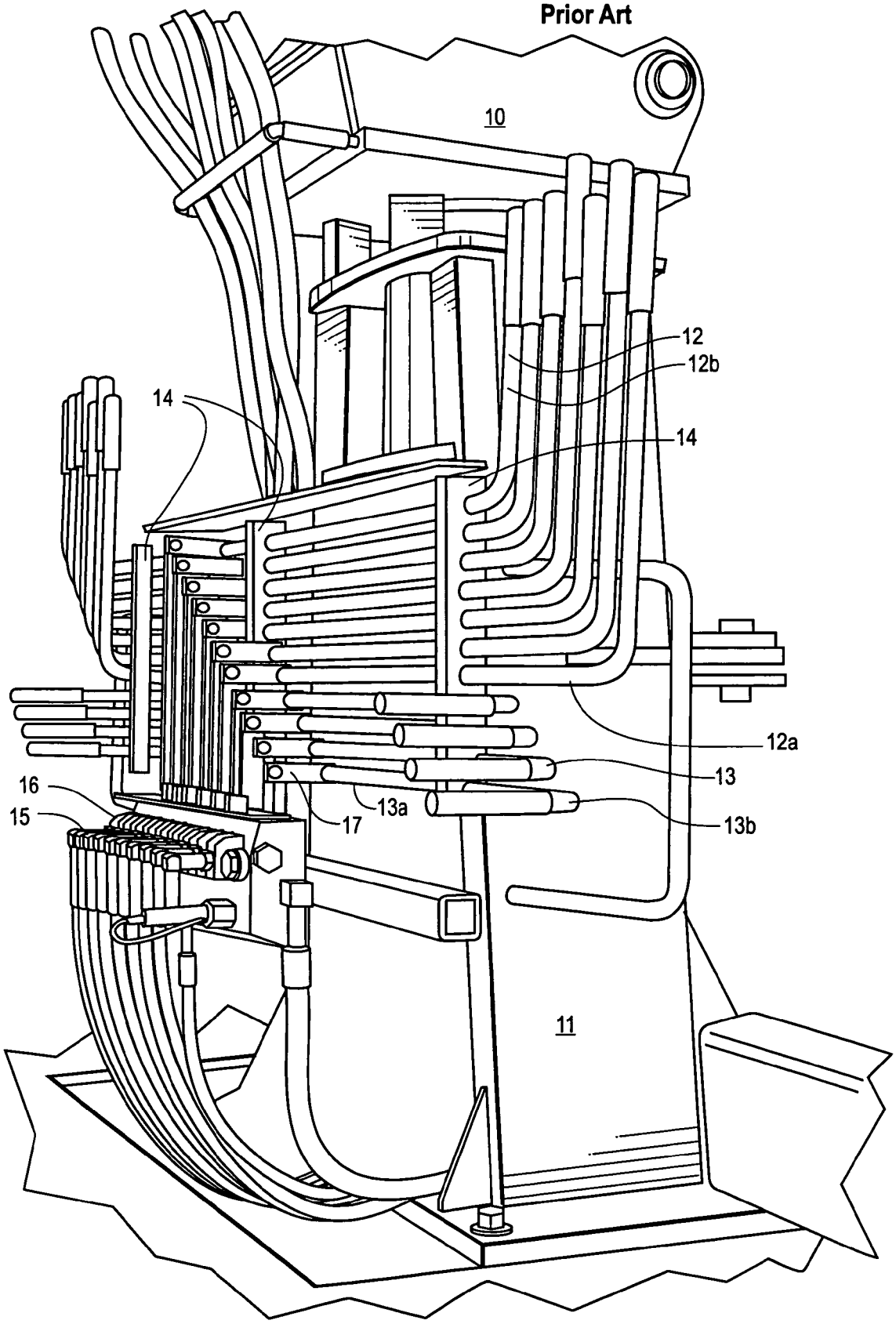
Fig. 1 Prior Art
FIGS. 1-4 illustrate prior art control mechanisms.
Figure 2:
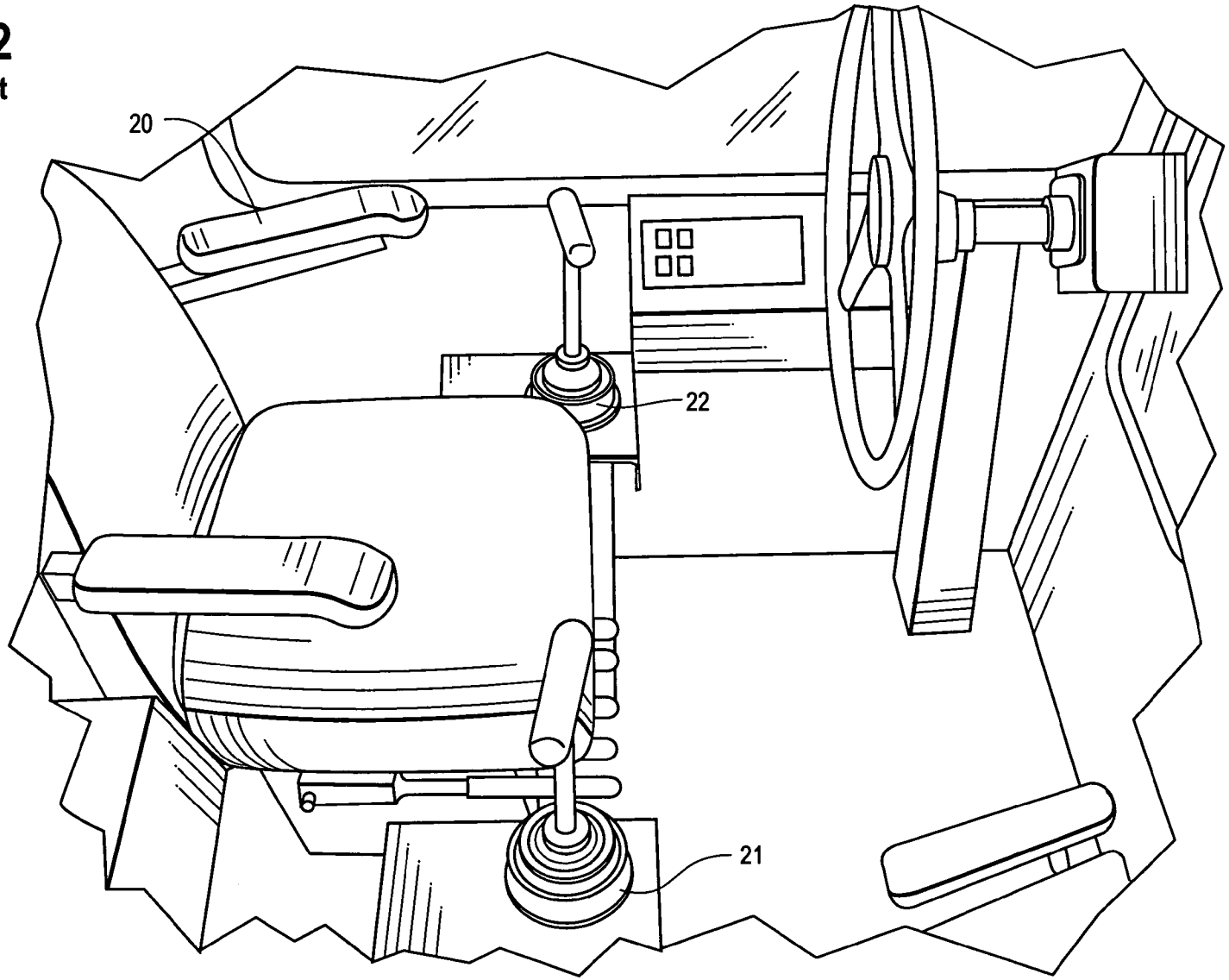
Fig. 2 Prior Art
Figure 3:
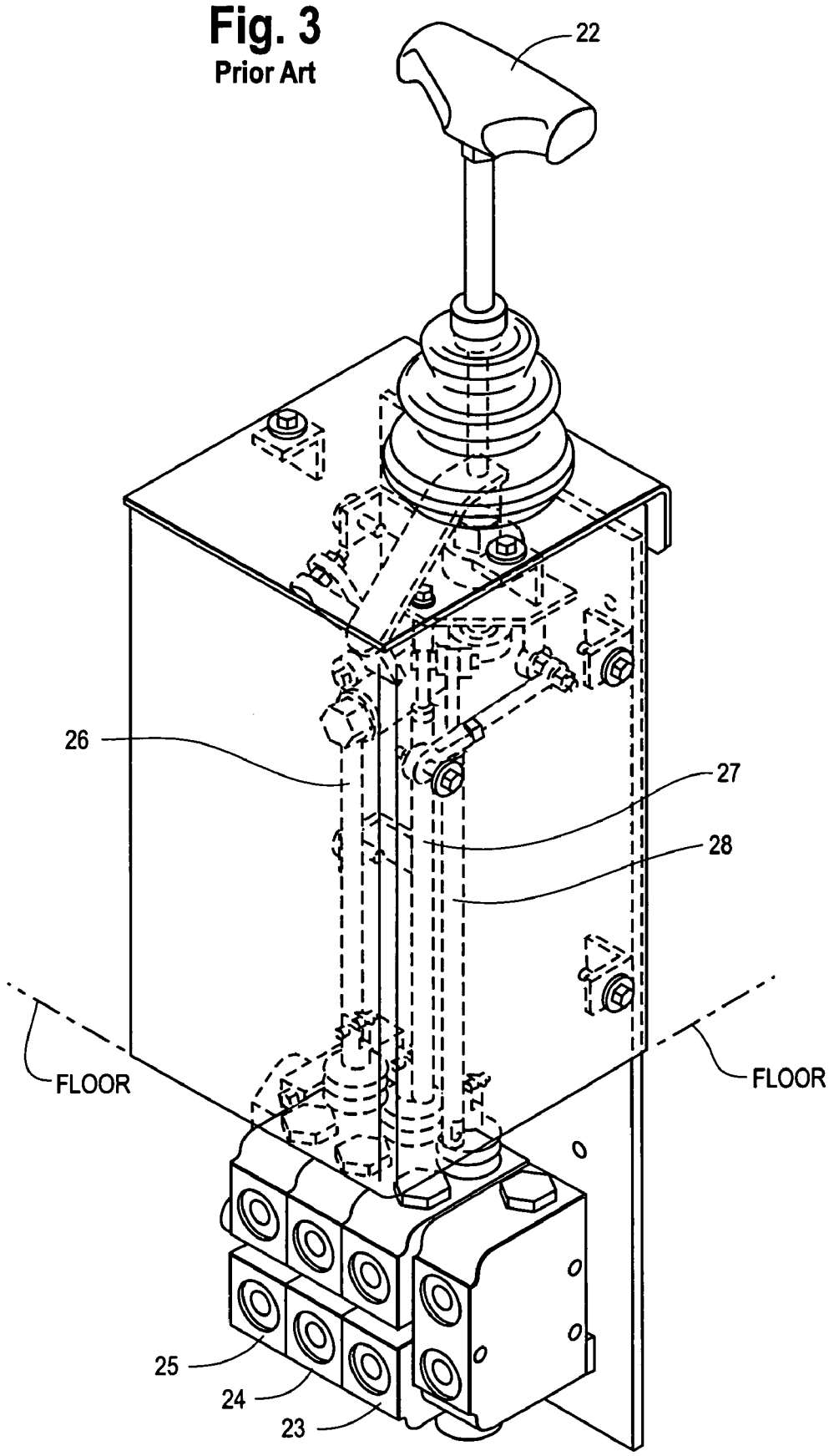
Fig. 3 Prior Art
Figure 4:
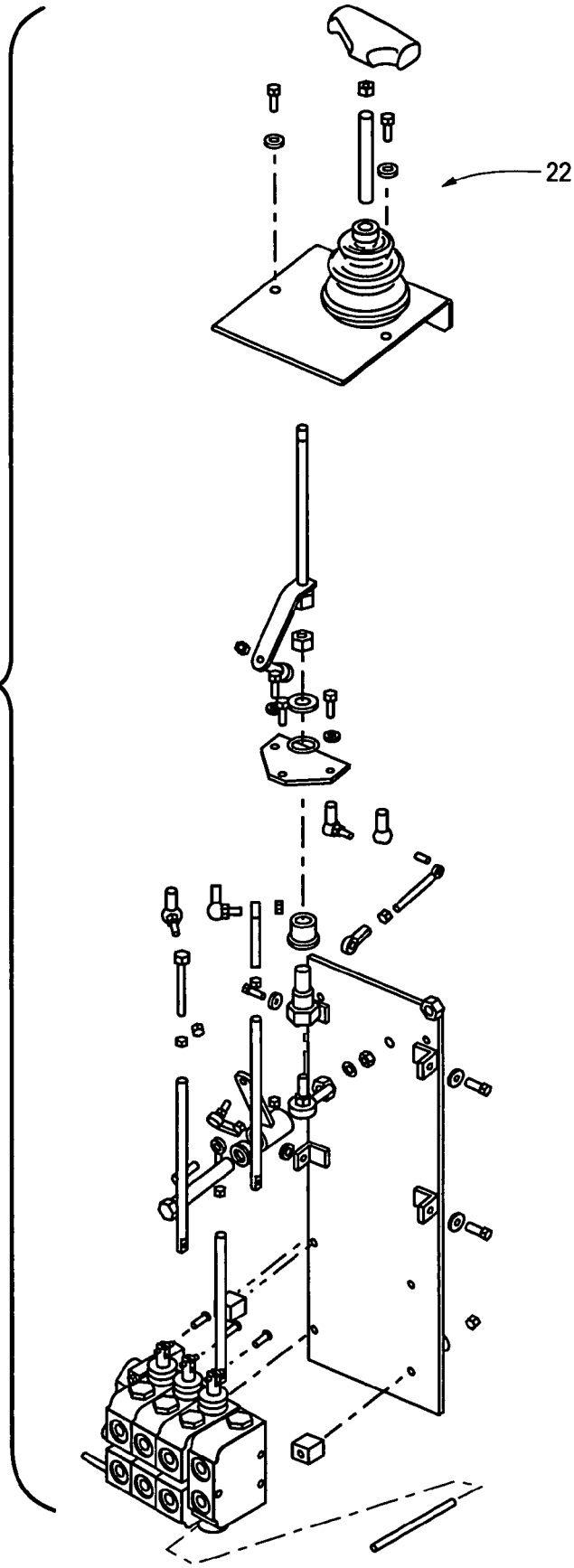
Fig. 4 Prior Art
Figure 11:
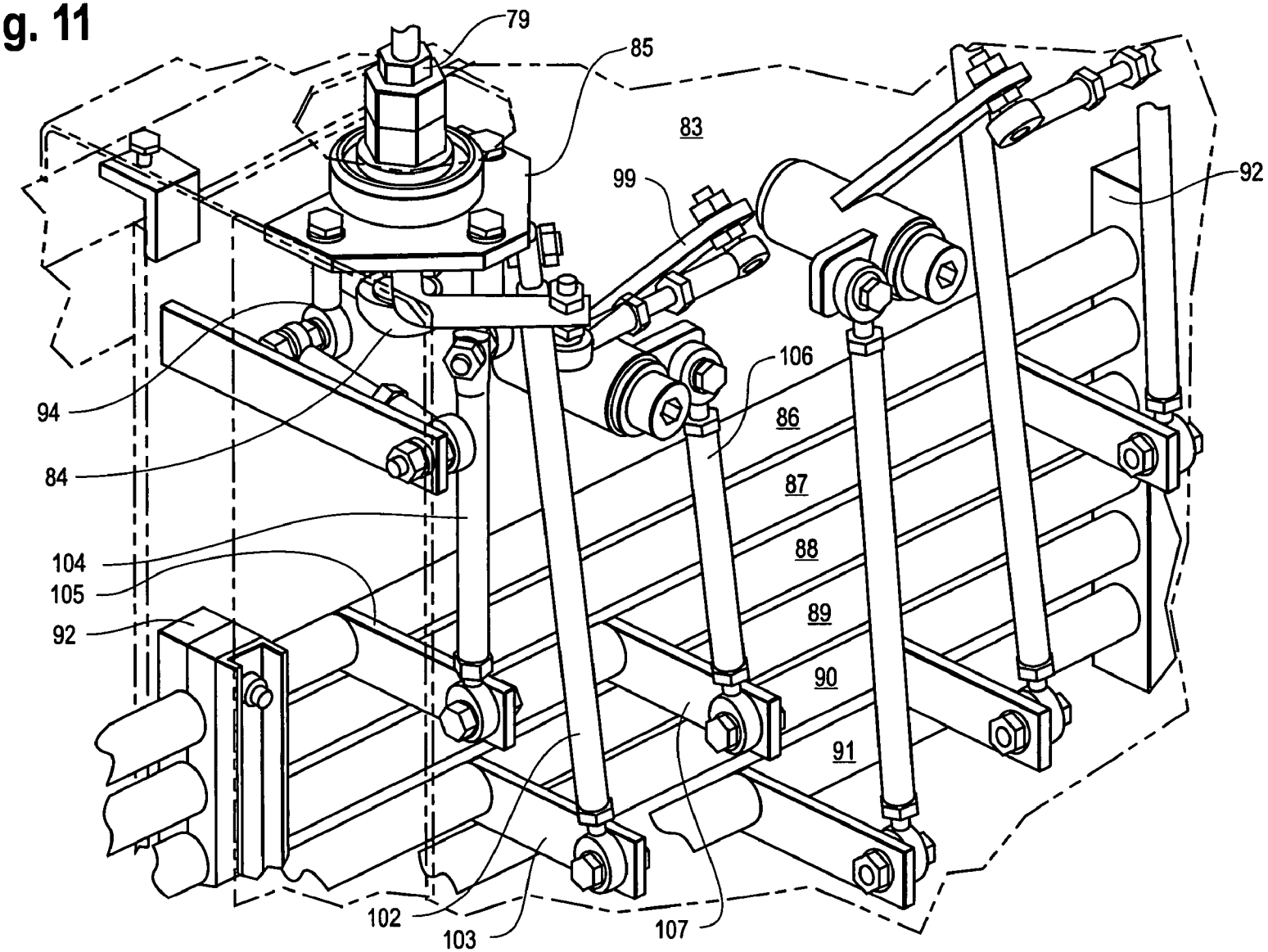
FIG. 11 is an enlarged fragmentary view of one of the three-function joysticks of FIG. 9.
Figure 12:
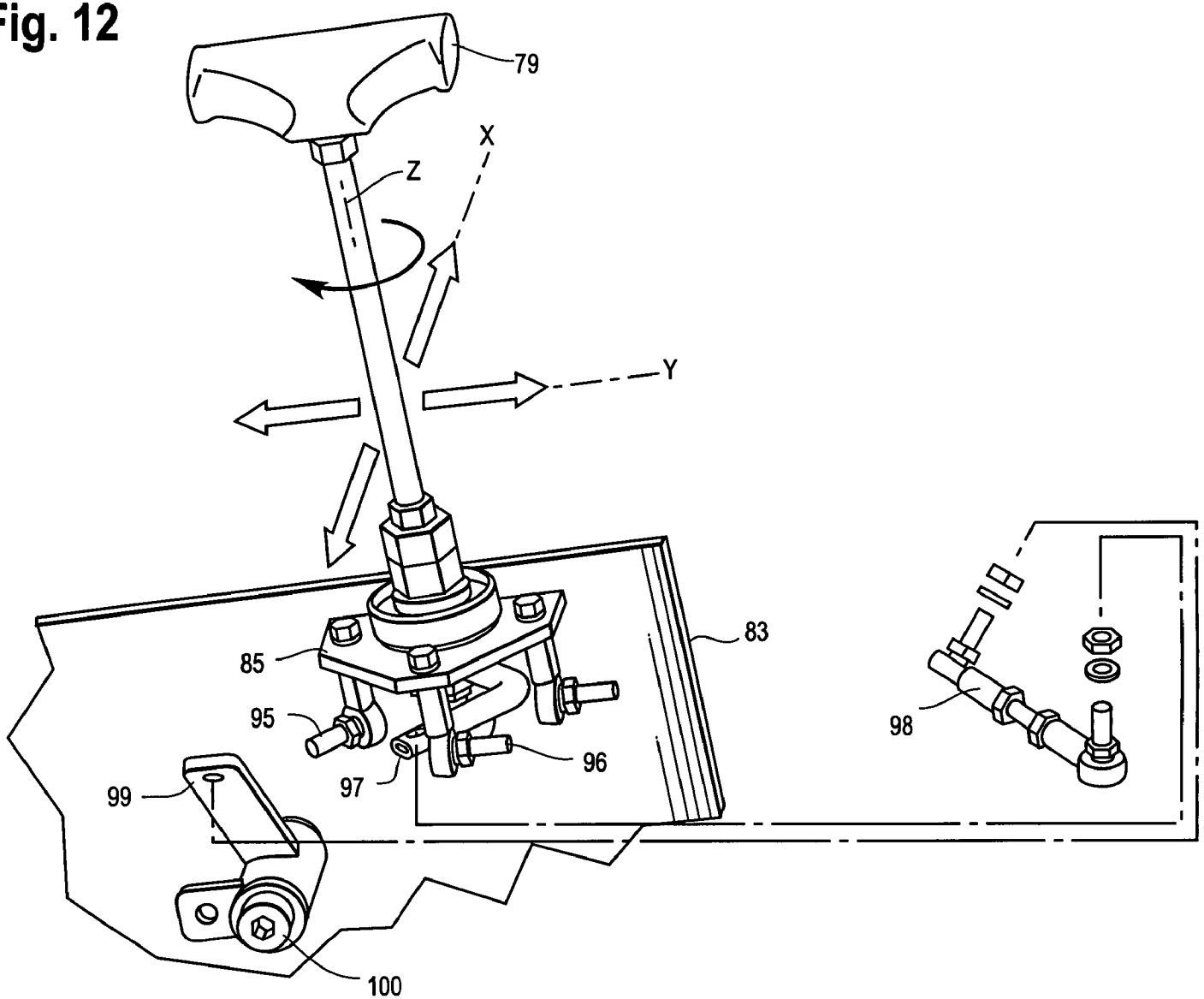
FIG. 12 is a fragmentary perspective view of the other three-function joystick of FIG. 9.
Figure 13:
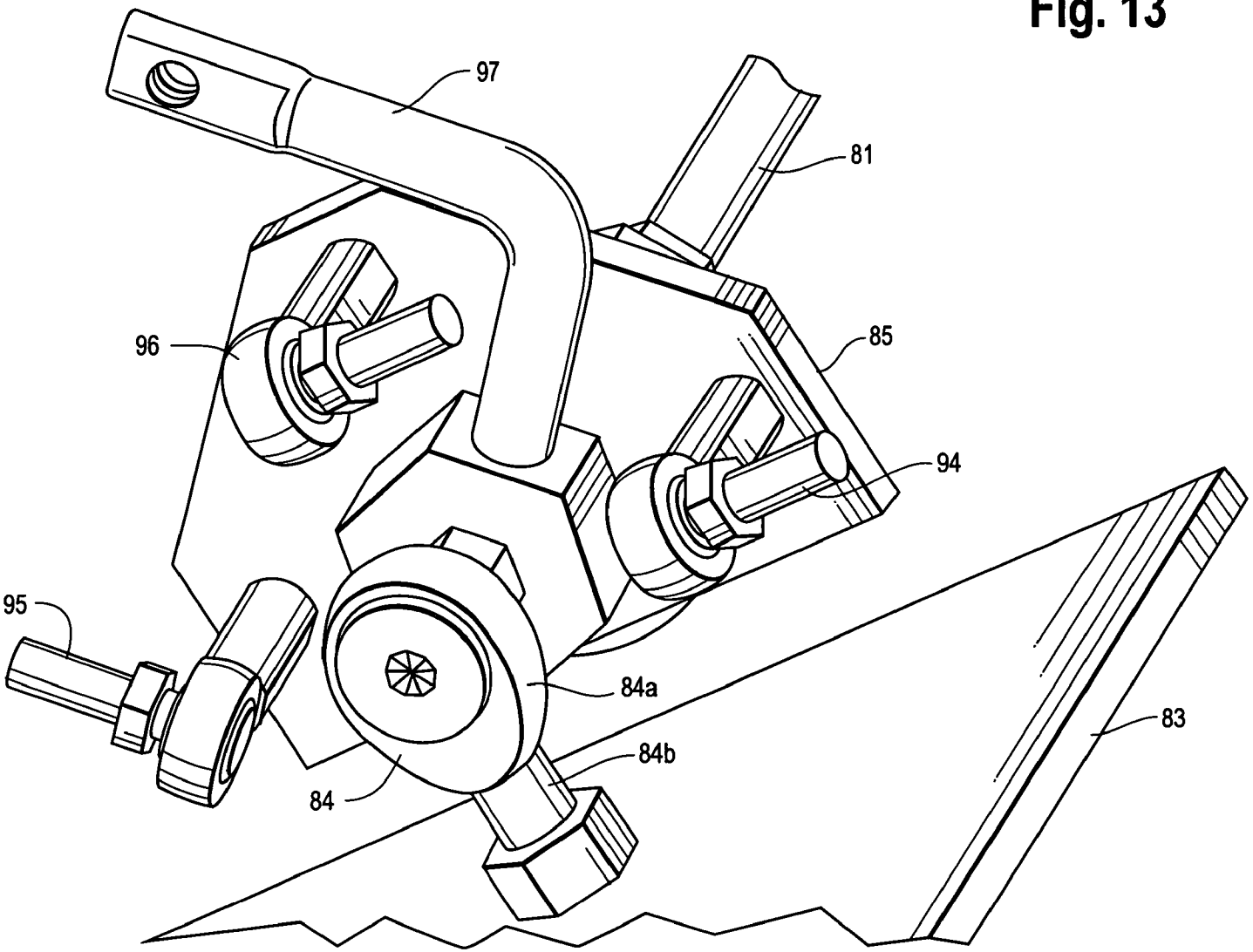
FIG. 13 is a fragmentary bottom perspective view of the joystick of FIG. 12.

The joysticks 78 and 79 operate generally in the same way as the prior art joysticks which are illustrated in FIGS. 2-4, but the joysticks are connected to, and operate, the valves in a substantially different manner. Referring to FIGS. 11 and 12, each lever plate 85 is attached to the frame 83 by an anti-rotation ball joint 94. Left-right linkage 95 is moved up and down by the lever plate when the joystick moves right and left. Push-pull linkage 96 is moved up and down by the lever plate when the joystick moves along the push-pull axis. An L-shaped link 97 is rotated when the joystick is rotated, and the link 97 is connected by linkage 98 to a bell crank 99. The bell crank 99 is rotatably mounted on the frame 83 by a bolt 100.

Referring to FIGS. 9 and 11, the left-right linkage of the left joystick 78 is connected by a vertical connecting rod 102 to a crank arm 103 attached to the horizontal rod 89. The push-pull linkage is connected by a vertical connecting rod 104 to a crank arm 105 attached to the horizontal rod 86. The bell crank 99 is connected by a vertical connecting rod 106 to a crank arm 107 attached to the horizontal rod 88.

When the left joystick 78 is moved in the x or push-pull direction, the connecting rod 104 and crank arm 105 move up or down. The crank arm is pivotally connected to the connecting rod and is attached to horizontal rod 86 so that movement of the connecting rod rotates the horizontal rod 86.

When the left joystick 78 is moved in the y or left-right direction, the connecting rod 102 and crank arm 103 move up or down and rotates horizontal rod 89. When the joystick 78 is rotated around the z or twisting axis, the connecting rod 106 and crank arm 107 move up or down and rotates horizontal rod 88.

The right joystick 79 is similarly connected to the horizontal rods 87, 90, and 91 by vertical connecting rods 108-110 and crank arms 111-113. Each of the horizontal rods 87, 90, and 91 can therefore be rotated by movement of the joystick 79.

Referring again to FIG. 8, each of the horizontal rods 86-91 is connected to one of the first six valve spool assemblies 67 by a crank arm 115 and a vertical connecting rod 116. Each vertical connecting rod is connected to one of the valve spools 69 so that rotation of a horizontal rod raises or lowers a valve spool. When a valve spool is raised, pressurized hydraulic fluid flows through one of the hydraulic hoses which is connected to the valve, and when the valve spool is lowered, pressurized hydraulic fluid flows through the other hydraulic hose which is connected to the valve.

The left joystick 78 of each of the operating stations 76 and 77 operates the same three horizontal rods 86, 88, and 89, and the right joystick 79 of each of the operating stations operates the same horizontal rods 87, 90, and 91. The hydraulic actuators can therefore be controlled at each station.

Referring to FIG. 8, four of the remaining valve spool assemblies 67 on the right side of the valve bank 66 can be used to operate the two outriggers on each side of the vehicle. Two of those valve spools can be used to control up and down and in and out movement of the outrigger on one side of the vehicle, and two of the valve spools can be used to control up and down and in and out movement of the outrigger on the other side of the vehicle. Those four valve spools can be operated by two conventional two-function joysticks 120 and 121 which are mounted directly on the valve spool assemblies. The joysticks 120 and 121 are available from Parker Hannifin Corporation.

In FIG. 8 the lever plates of the joysticks and the associated linkages are concealed by covers 123 and 124 which are removably attached to the frame 83.

Figure 14:
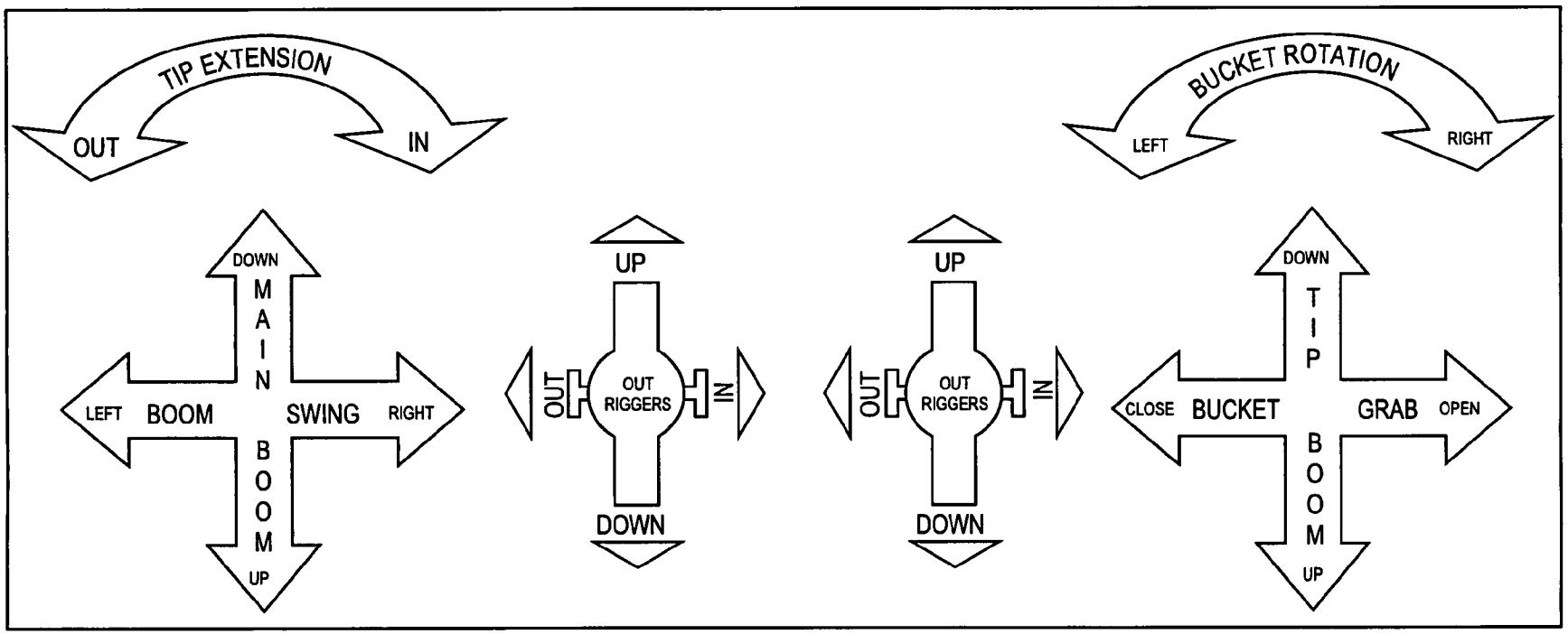
FIG. 14 is an operational diagram of the functions which are performed by the hydraulic control apparatus.

FIG. 14 is an operational diagram which can be used as operating instructions at each of the two operating stations 76 and 77. The left joystick at each station operates the hydraulic actuators 40, 41, and 46 for causing Boom Swing Left and Right, Main Boom Up and Down, and Tip Extension extend and retract. The right joystick at each operating station operates the actuators 45, 59, and 50 for causing Tip Boom Up and Down, Bucket Grab Open and Close, and Bucket Rotation Left and Right.

Although we have described the hydraulic control apparatus for use in controlling six hydraulic operating functions of a loader, the control apparatus can be used for controlling fewer functions. For example, only one three-function joystick could be used for controlling three operating functions. Also, the hydraulic control apparatus can be used to control the hydraulic valves of devices other than loaders. Any hydraulically operated device which includes three hydraulic functions can be controlled with a three-function joystick as described herein.

The hydraulic actuators which are controlled by the control apparatus can be linear actuators for causing linear motion, e.g., hydraulic cylinders, rotary actuators for causing rotary motion, or other types of hydraulic actuators or hydraulic motors which cause movement in response to hydraulic pressure.

While in the foregoing specification a detailed description of a specific embodiment was set forth for the purpose of illustration, it will be understood that many of the details herein given maybe varied considerably by those skilled in the art with not departing from the spirit and scope of the invention.

I claim:

1. In a loading apparatus comprising:

a) a frame, b) a boom assembly rotatably mounted on the frame, the boom assembly including:

i) a pedestal;

ii) a rotating head rotatably mounted on the pedestal;

iii) a first hydraulic actuator for rotating the rotating head;

iv) a main boom arm pivotally connected to the rotating head;

v) a second hydraulic actuator for raising and lowering the main boom arm;

vi) a tip boom arm pivotally connected to the main boom arm;

vii) a third hydraulic actuator for raising and lowering the tip boom arm relative to the main boom arm;

viii) a tip boom extension telescopingly mounted on the tip boom arm;

ix) a fourth hydraulic actuator for extending and retracting the tip boom extension;

x) a bucket rotatably mounted on the tip boom extension and including at least one movable arm, to open and close bucket sides;

xi) a fifth hydraulic actuator for moving said movable arm;

xii) a sixth hydraulic actuator for rotating the bucket, c) a valve assembly including six hydraulic valves, each of the six hydraulic valves being hydraulically connected to one of the six hydraulic actuators for supplying hydraulic fluid to the hydraulic actuator, the improvement comprising:

d) first and second three-function joysticks mounted on the frame at one position;

e) a third and fourth three-function joysticks mounted on the frame at another position;

f) each of said three-function joysticks including a handle which is movable with respect to first, second and third axes;

g) a first set of three rods rotatably mounted on the frame and extending between and connected to the first and third joysticks;

h) a second set of three rods rotatably mounted on the frame and extending between and connected to the second and fourth joysticks, each of said rods being mechanically connected to one of said hydraulic valves whereby rotation of one of the rods operates one of the hydraulic valves, whereby all of the six hydraulic valves are operable by either the first and second joysticks or the third and fourth joysticks.

2. A control apparatus for operating a hydraulic valve assembly from first and second positions, the hydraulic valve assembly including at least three hydraulic valves, comprising:

a first three-function joystick at said first position, a second three-function joystick at said second position, three rods extending between the first and second joysticks, each of said first and second three-function joysticks including a handle which is movable:

a) along a first axis for rotating one of said rods, b) along a second axis for rotating a second of said rods, c) about a third axis for rotating a third of said rods, each of said rods being mechanically connected to one of said valves whereby rotation of each rod operates one of the valves.

3. The structure of claim 2 including a crank arm mechanically connecting each of said rods to one of said valves.

4. A control apparatus for operating a hydraulic valve assembly from first and second positions, the hydraulic valve assembly including at least six hydraulic valves, comprising:

first and second three-function joysticks at said first position, third and fourth three-function joysticks at said second position, a first set of three rods extending between the first and third joysticks, a second set of three rods extending between the second and fourth joysticks, each of said first and third three-function joysticks including a handle which is movable;

a) along a first axis for rotating one of the rods of said first set, b) along a second axis for rotating a second rod of said first set, c) about a third axis for rotating a third rod of said first set, each of said second and fourth three-function joysticks including a handle which is movable:

a) along a first axis for rotating one of the rods of the second set, b) along a second axis for rotating a second rod of said second set, c) about a third axis for rotating a third rod of said second set, each of said rods being mechanically connected to one of said valves whereby rotation of each rod operates one of the valves.

5. The structure of claim 4 including a crank arm mechanically connecting each of said rods to one of said valves.

* * * * *